US007399018B1

(12) United States Patent
Khachaturian

(10) Patent No.: US 7,399,018 B1
(45) Date of Patent: Jul. 15, 2008

(54) LIFTING SLING

(76) Inventor: Jon E. Khachaturian, 1111 Engineers Rd., Belle Chasse, LA (US) 70037

( * ) Notice: Subject to any disclaimer, the term of this patent is extended or adjusted under 35 U.S.C. 154(b) by 0 days.

(21) Appl. No.: 10/847,631

(22) Filed: May 17, 2004

Related U.S. Application Data

(60) Provisional application No. 60/470,695, filed on May 15, 2003.

(51) Int. Cl.
*B66C 1/12* (2006.01)

(52) U.S. Cl. ..... 294/74

(58) Field of Classification Search ..... 294/74, 294/86.42; 57/22, 202
See application file for complete search history.

(56) References Cited

U.S. PATENT DOCUMENTS 2,558,553 A * 6/1951 Hansen et al. ..... 57/202
2,643,638 A * 6/1953 Villmer ..... 294/74
2,947,504 A * 8/1960 Ruhlman ..... 248/63
2,981,053 A * 4/1961 Harrison ..... 57/21
3,007,300 A * 11/1961 Peterson ..... 57/311
3,067,570 A * 12/1962 Nischan ..... 57/202
3,120,734 A * 2/1964 Peterson et al. ..... 57/202
3,338,046 A * 8/1967 Baur et al. ..... 57/223
5,699,657 A * 12/1997 Paulson ..... 57/22

* cited by examiner

*Primary Examiner*—Saul J. Rodriguez
*Assistant Examiner*—Paul T Chin
(74) *Attorney, Agent, or Firm*—Garvey, Smith, Nehrbass & North, L.L.C.; Charles C. Garvey, Jr.

(57) ABSTRACT

A lifting sling and a lifting grommet are disclosed which can be fabricated of a high tensile strength polymeric material, preferably a woven polymer such as liquid crystal polymer fibers, that are woven in a rope or cable configuration. The apparatus features an elongated woven material length of cable that is spliced. Plastic, preferably polyurethane spring cut tube sleeves are positioned as a grip on the splices to allow for handling in the field without concern for the splice becoming disassembled or undone. The sling and grommet of the present invention can each be provided with a clear cover spring cut tube that serves as a flexible protective cover for minimizing abrasion and maintaining the slings appearance.

56 Claims, 7 Drawing Sheets

LIFTING SLING

CROSS-REFERENCE TO RELATED APPLICATIONS

Priority of U.S. Provisional Patent Application Ser. No. 60/470,695, filed May 15, 2003, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to rigging, namely slings and grommets that are used during heavy lifting and more particularly to a heavy lifting system that includes a specially configured sling and grommet of improved construction wherein an elongated sling member includes an elongated woven portion having first and second ends and a central passageway surrounded by the woven material, and wherein one or more flexible sleeves can be optionally fitted to the elongated sling member at its loop portions and at its connecting portions. If the tensile material is one large circular loop, it is referred to as a grommet. These elongated sleeves are preferably of a spiral construction that can be easily installed in the field once a sling length is selected, and function to prevent abrasion during use and to prevent slippage at the splice. The grommet has a similar flexible sleeve fitted to splices of the grommet.

2. General Background of the Invention

In the lifting of very heavy items, lifting harnesses are typically employed which comprise an elongated length of tensile material having loops at each end. These slings have commonly taken the form of wire rope having looped ends. In the case of wire rope, the looped ends are often secured using a crimp or band. Once the sling is constructed, its length is "fixed". A user must plan the lift in advance by selecting slings of a desired fixed length.

Polymeric and plastic material has been used to construct slings and grommets. A grommet is a sling that is circular in shape so that the user simply hooks or grabs the entire sling rather than a looped end portion. New England Ropes publishes a "Splicing Guide" that discloses various rope splicing techniques.

One of the problems with slings and grommets of either metallic or plastic construction is that of field adjusting the sling length. Wire rope slings are not adjustable. Plastic and polymeric slings are typically sewn to form the loops so that they are not easily adjustable on the job site.

One polymeric material that has a high tensile strength is liquid crystal polymer fiber. One brand that is manufactured by Celanese Acetate LLC is sold under the trademark Vectran®. Celanese literature states that Celanese has contracted aerospace and rope manufacturers to conduct pin diameter tests on Vectran® braid and wire rope respectively. The same literature shows a braid test using a braid having two eyes at the ends. However, this type of "test" braid would quickly become disassembled and or slip in routine use as a sling in a construction environment.

When rigging for many different lifts during a day, a rigger desirably wants a sling that is adjustable so that the length can be varied to fit the particular item being lifted. Further, slings should not slip or become disassembled on the job.

BRIEF SUMMARY OF THE INVENTION

The present invention provides an improved lifting system that features a specially configured lifting sling that is comprised of an elongated sling member that includes an elongated woven portion having first and second ends and a central passageway surrounded by woven material.

With the present invention, first and second connections join each end of the woven portion at the central passageway and at spaced apart positions to form eyes or loops (see FIG. 1). One or more flexible spiral cut sleeves can be fitted to the sling, preferably at the eyes or loops. Each sleeve defines an interface between the loop and a lifting member that engages the eye in the preferred embodiment.

The lifting eyes can also be used to be fitted to the woven portion to prevent or discourage slippage after the sling is constructed.

The flexible sleeve can include a spirally configured portion. The flexible sleeve can be a polymeric or polyurethane member, preferably including liquid crystal polymer fibers.

The present invention can be constructed in the form of a grommet or circular sling that does not have loops.

The present invention is easy to fabricate, can be reused at different lengths, and is easy to reuse in a different form (sling, grommet, etc.). The present invention features a sleeve which is preferably in the form of a polyurethane, spiral cut or spring cut tube. This sleeve serves as a grip or compression on the splice to allow for handling in the field without having any concern that the splice will come apart.

The sleeve is preferably removable so it can be reused with different slings of different lengths from day to day.

A polyurethane spring cut sleeve or tube also serves as a flexible thimble at the "bite" or eye of the sling to prevent abrasion and rapid wear at these critical points.

A polyurethane spiral cut or spring-cut clear cover can also be used over the entire length of the sling that is otherwise not covered as a flexible protective cover, minimizing abrasion and keeping the sling intact.

The present invention features an insert that is preferably of straight fiber filler (preferably liquid crystal polymer fiber) for increasing the sling strength at the bite point in a grommet opposite the splice entry point.

This straight insert section of fiber filler increases the sling strength at the bite point in a doubled over eye and eye sling when positioned opposite the two eyes (see FIG. 2).

One embodiment of the present invention is a grommet (see FIG. 3). In one embodiment, a preformed spiral cut thimble offers additional protection at the sling bite while still being removable (see FIGS. 16-18).

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 1, 2, 3:
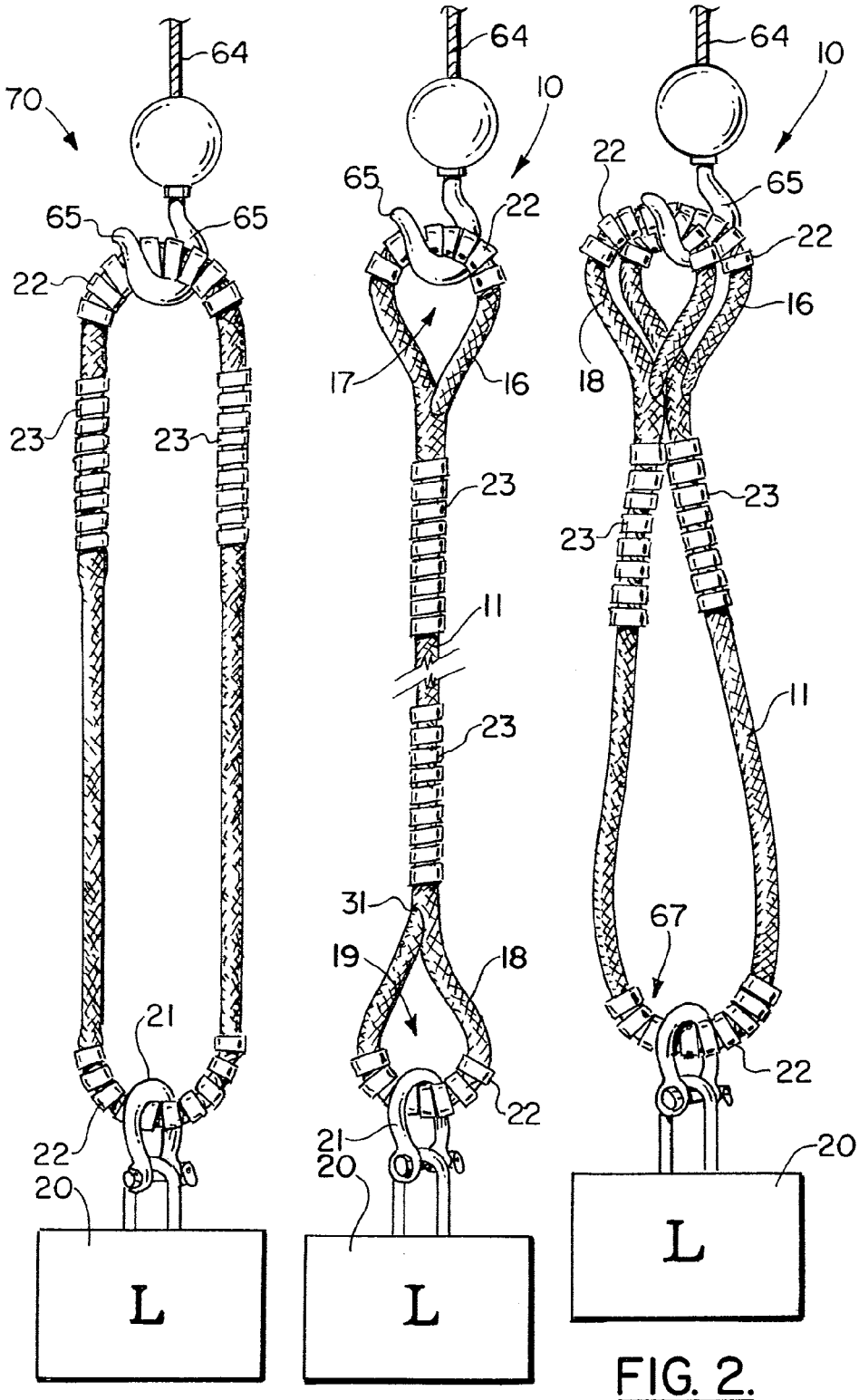
FIG. 1 is a front, elevational view of the preferred embodiment of the apparatus of the present invention.
FIG. 2 is a front, elevational view of the preferred embodiment of the apparatus of the present invention showing the sling in a doubled configuration.
FIG. 3 is a front, elevational view of a second embodiment of the apparatus of the present invention showing a grommet.

FIGS. 1 and 2 show generally the preferred embodiment of the apparatus of the present invention designated generally by the numeral 10. Lifting sling 10 includes a sling member 11 (preferably polymeric, more preferably liquid crystal polymer) that can be provided with a pair of spaced apart lifting eyes 16, 18 as shown in FIGS. 1 and 2.

In FIG. 2, the sling member 11 is much longer and is doubled so that both of the lifting eyes 16, 18 are positioned in side by side relationship and supported by hook 65 attached to crane lifting line 64. In FIG. 1, a single strand configuration for sling 10 is shown with the lifting eye 16 being attached to hook 65. The lower lifting eye 18 is attached to shackle 21 which is affixed to both lifting eye 18 and load 20 to be lifted.

Lifting eye 16 provides an opening 17 that enables it to be attached to hook 65 of a crane and its lifting line 64. Similarly, eye 18 has an opening 19 that enables it to be attached to an object to be lifted such as load 20 or to a shackle 21 that forms an interface between load 20 and eye 18.

Figure 4:
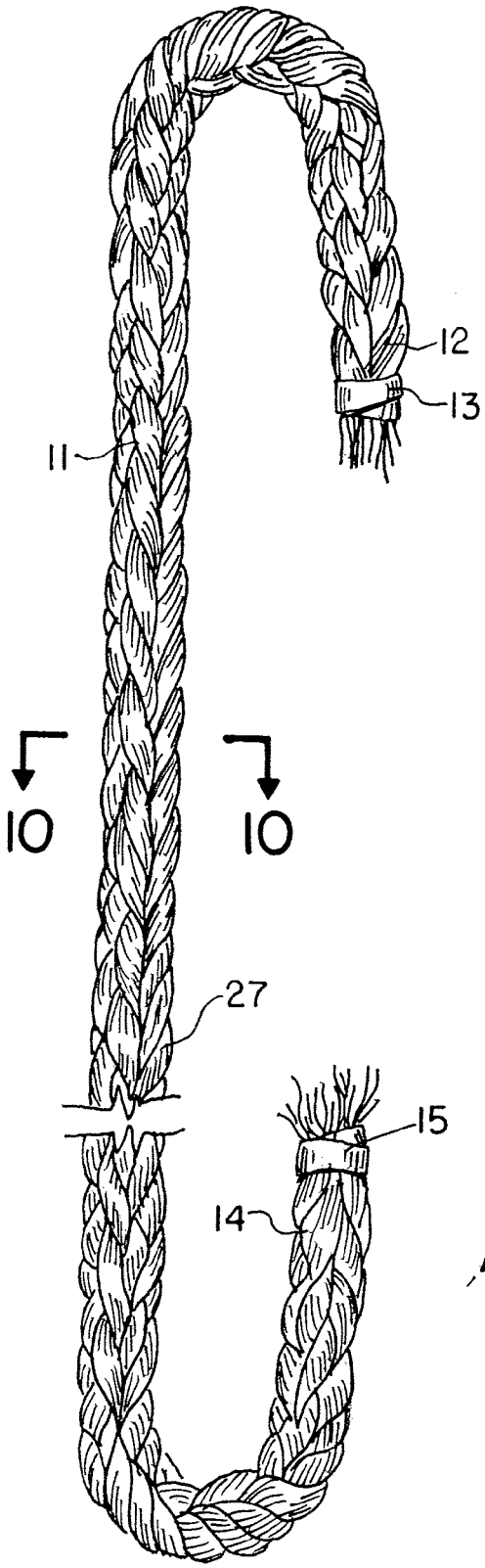
FIG. 4 is a front, elevational view of a portion of the preferred embodiment of the apparatus of the present invention shown prior to formation in sling or grommet form.

The sling member 11 is shown in FIG. 4 before assembly. One of the features of the present invention is that a sling can be constructed and used in the field of a selective length because the sling length can be changed at any time by the user. This is accomplished by beginning with a sling member 11 that is an elongated member comprised of a woven portion 27 having end portions 12, 14 as shown in FIG. 4. The end portion 12 is preferably contained with band 13 to prevent unraveling. Similarly, a band 15 is provided at end portion 14.

In the preferred embodiment, the woven material 27 that comprises sling member 11 is a liquid crystal polymer (LCP) fiber material that is very strong. Such a product is manufactured by Celanese Acetate LLC under the trademark Vectran®.

One of the problems with liquid crystal polymer material is that it typically has a tendency to abraid when used in the hostile environment of a lifting sling in an industrial plant. when spliced, this material can carry a substantial load so long as the splice is loaded and maintained in tension, such as in a controlled setting (eg. lab). However, in an industrial plant or construction environment, slings of this type are handled with little care. They can be, for example, thrown on the ground, rolled over by heavy vehicles, subjected to dragging across dirt, gravel, sand, etc. In such a hostile environment, the splice can easily shift positions or become completely disassembled.

The present invention provides a plurality of spring cut or spiral cut sleeves such as sleeves 22, 23. These spiral cut sleeves 22, 23 include sleeves 22 that are configured to be positioned at the bite area 34 of a lifting eye 16 or 18 as shown in FIGS. 1-13 and 15.

The spiral cut sleeves 22, 23 are also provided at the area of splices, those sleeves being designated by the numeral 23. For example, in FIG. 1, the sling 10 is provided with two spiral cut sleeves 22 at the bite area 34 of both lifting eyes 16 and 18. Additionally, the sling 10 in FIG. 1 is provided with two spiral cut sleeves 23 that are provided at the splice area next to each of the lifting eyes 16 and 18.

In FIG. 2, the elongated sleeve 10 is of the same configuration generally as the sling of FIG. 1. However, in FIG. 2, there are five spiral cut sleeves provided. There are two spiral cut sleeves 23 at the splice areas next to the lifting eyes 16 and 18. There are three spiral cut sleeves 22 placed at the bite areas. These include the bite area 34 of each lifting eye 16, 18 and the bite area 64 that is positioned about midway between the lifting eyes 16, 18 as shown in FIG. 2.

For the grommet 70 of FIG. 3, there are four spiral cut sleeves provided. These include the spiral cut sleeves 22 at the bite areas of the grommet 70 and the spiral cut sleeves 23 provided at the splice areas of the grommet 70.

Figure 5:
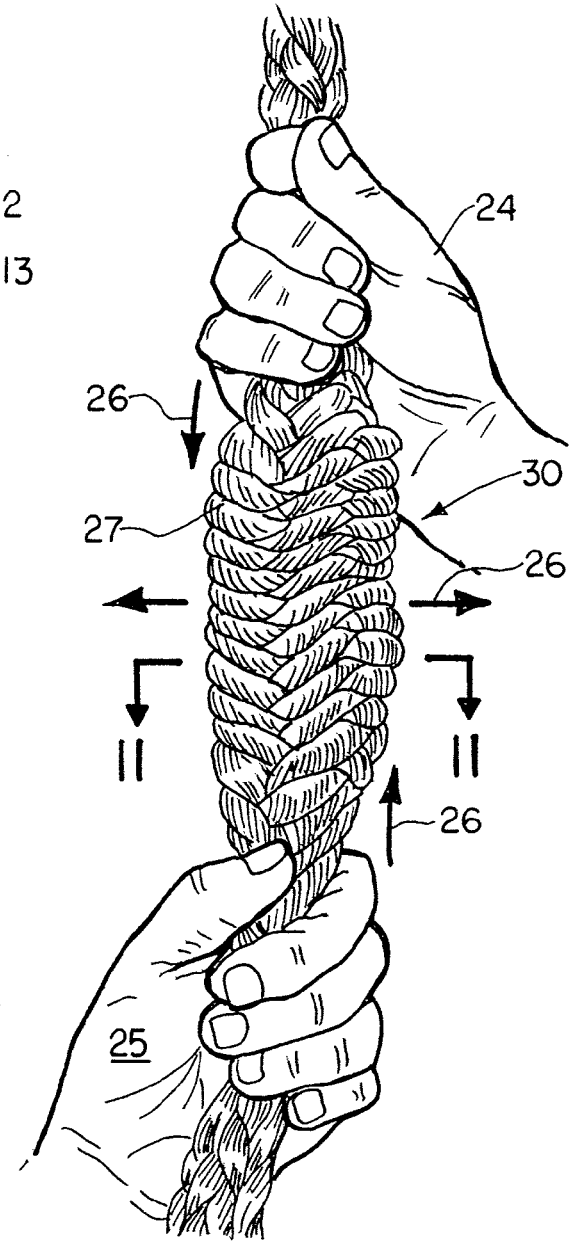
FIG. 5 is a schematic, front, elevational view showing a portion of the apparatus of the present invention during forming.
Figure 6:
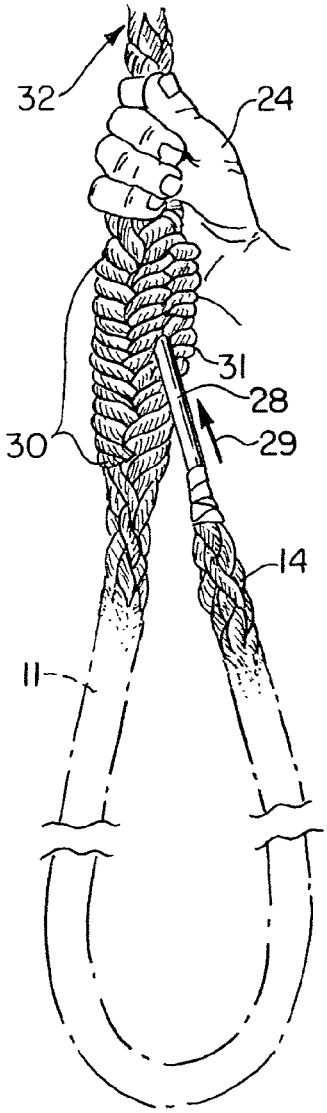
FIG. 6 is a front, elevational view of the preferred embodiment of the apparatus of the present invention showing a sling during forming.
Figure 7:
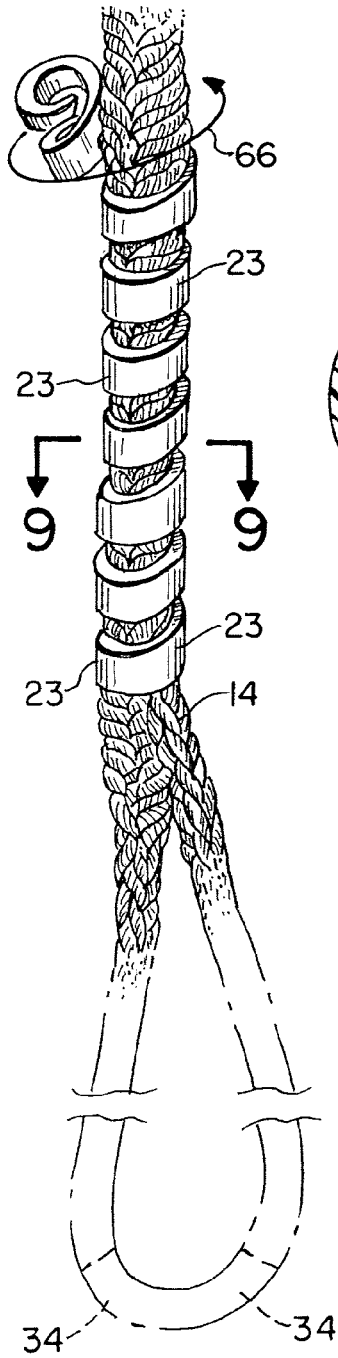
FIG. 7 is a front, elevation, fragmentary view of the preferred embodiment of the apparatus of the present invention.
Figure 10:
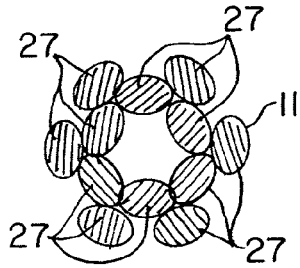
FIG. 10 is a sectional view taken along lines 10-10 of FIG. 4.
Figure 11:
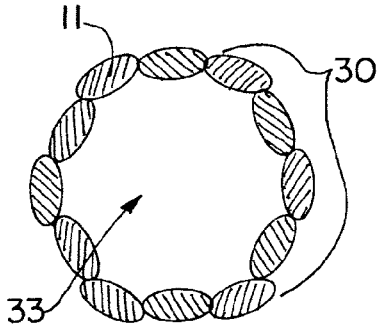
FIG. 11 is a sectional view taken along lines 11-11 of FIG. 5.

FIGS. 5, 6 and 7 illustrate assembly of the lifting sling 10 of the present invention by a user in the field. The apparatus of the present invention enables a user such as an engineer, crane operator, construction foreman or the like to construct a sling 10 of any desired length and to adjust the length of the sleeve in the field. In FIG. 6, a splicing tool 28 is attached to end portion 14 of sling member 11. A user's hands 24, 25 in FIG. 5 are moved together in the direction of arrows 26, in order to thicken or expand a portion of the sling member 11 to produce the expanded section 30 shown in FIGS. 5 and 6. The expanded section 30 is also shown in a sectional view of FIG. 11. FIG. 11 should be compared with FIG. 10, showing the normal cross sectional configuration of sling member 11 and specifically its woven portion 27.

The woven portion 27 can be comprised of a plurality of for example, twelve (12) plies surrounding a central passageway 33. In FIG. 11, the passageway 33 has been greatly enlarged as shown to accommodate splicing tool 28 and end portion 14 of sling member 11. Arrow 29 in FIG. 6 schematically illustrates the placement of splicing tool 28 into opening 31 in expanded portion 30 of sling member 11. The splicing tool 28 is then routed a desired distance away from the opening 31 in the direction of arrow 29.

In FIG. 6, position arrow 32 indicates schematically the terminal location for final placement of the end 14 portion of sling member 11 to complete the splice. It should be understood that this type of rope splice in general is known, being referred to and illustrated for example in the New England Ropes Splicing Guide has a single braid eye splice. The problem encountered in the lifting art, is that the use of such a single braid eye splice with very strong polymeric fibers such as liquid crystal polymer produces a sling that will easily slip or disassemble itself during field use and under hostile conditions found in industrial plants, construction sites, fabrication yards, etc. Therefore, there has not been a high strength, high tensile sling of liquid crystal polymer construction that could be field assembled, field adjusted, and still maintain integrity and strength during use.

With the present invention, the splice that extends between opening 31 and position 32 is covered with spiral cut sleeve 23 as shown in FIG. 7. Arrow 66 in FIG. 7 schematically illustrates the placement of spiral cut sleeve 23 upon the splice area that extends between opening 31 and position 32. The user simply continuously winds the spiral cut sleeve 23 upon the splice area as shown in FIG. 7 as indicated by the arrow 66.

Figure 12:
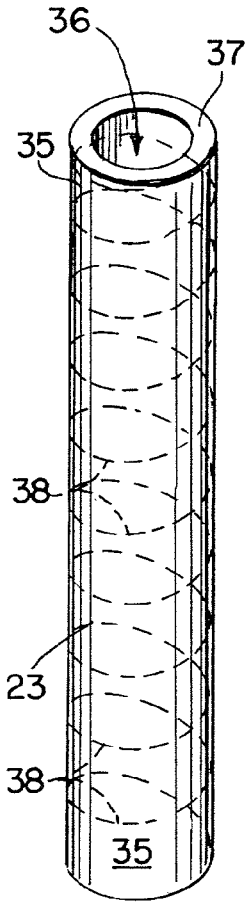
FIG. 12 is a perspective, fragmentary view of the preferred embodiment of the apparatus of the present invention showing the spiral cut tube prior to cutting.
Figure 13:
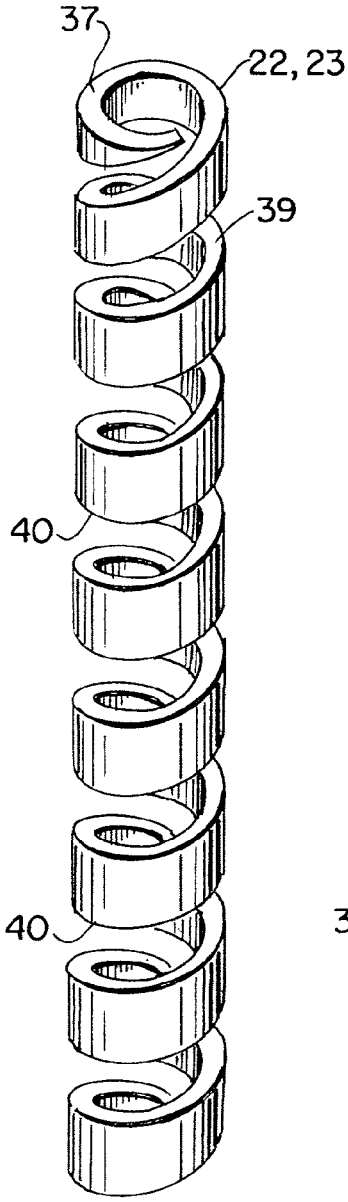
FIG. 13 is a fragmentary perspective view of the preferred embodiment of the apparatus of the present invention showing the spiral cut sleeve portion thereof.

The construction of a particular spiral cut sleeve 22 or 23 can be seen in FIGS. 12-13. In FIG. 12, each spiral cut sleeve 22 or 23 is first construction of a tube 35 having a tube bore 36 and a tube wall 37. Tube 35 is preferably of a polyurethane material. The dotted line 38 in FIG. 12 indicates the cut line for cutting tube 35 to produce spiral cut sleeves 22 or 23.

In FIGS. 12 and 13, the tube 35 can be any desired wall thickness for tube wall 37 and any desired bore diameter for bore 36 can be provided. By changing the bore diameter 36 and/or the thickness of wall 37, a desired flexibility can be provided for spiral cut sleeve 22 or 23. Similarly, by changing the bore diameter 36 or the wall thickness 37, a desired compression can be obtained for applying compression at the splice area of any sling that is constructed according to the method and apparatus of the present invention.

Figure 9:
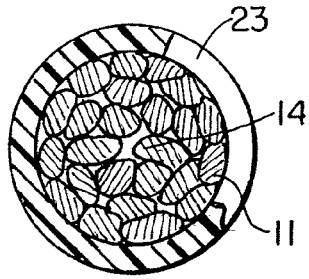
FIG. 9 is a sectional view taken along lines 9-9 of FIG. 7.

In FIG. 9, the compressive loading of the splice area is shown with the sleeve 23 tightly compacting the end portion 14 of sling member 11 within the central passageway 33 of a selected section of sling member 11. After the sleeve 35 is cut, a leading and trailing edge 39, 40 is defined as shown in FIG. 13 for the spiral cut sleeves 22, 23. These edges 39, 40 can be placed in a spaced apart orientation as shown in FIGS. 14 and 15 or can be placed very close together as shown with the spiral cut sleeves 23 in FIG. 1.

Figure 8:
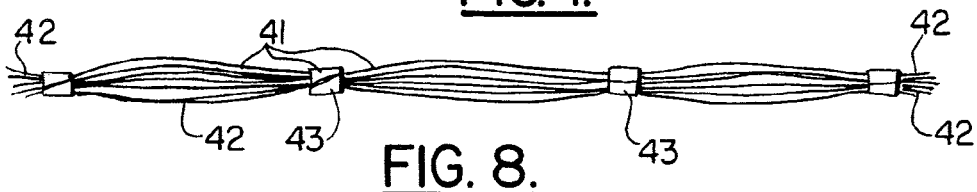
FIG. 8 is a front view of the insert portion of the preferred embodiment of the apparatus of the present invention, an optional component.
Figure 14:
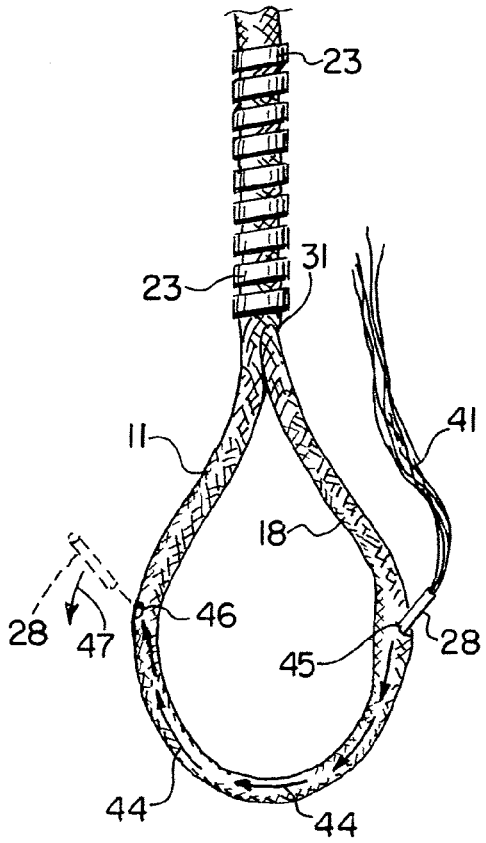
FIG. 14 is a fragmentary perspective view of the preferred embodiment of the apparatus of the present invention illustrating the placement of the insert portion into the bite area.
Figure 15:
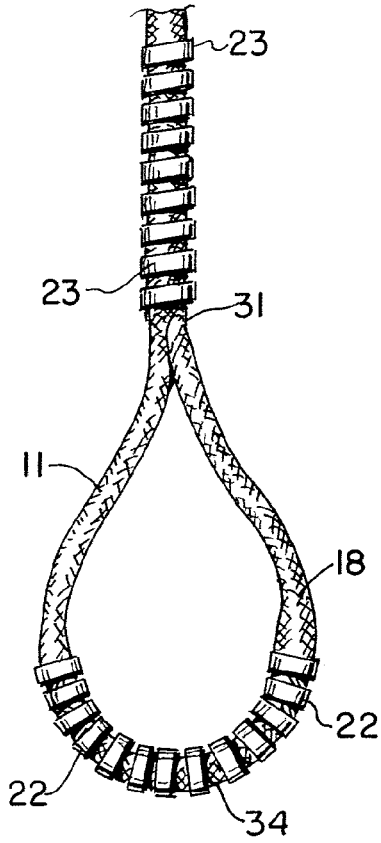
FIG. 15 is a fragmentary perspective view of the preferred embodiment of the apparatus of the present invention showing two spiral cut sleeves in position at the bite area and at the splice area.

In FIGS. 14 and 15, an insert 41 is shown for thickening the sling 10 of the present invention or the grommet 70 of the present invention as selected by a user. The insert 41 is shown more particularly in FIG. 8 as being comprised of a plurality of aligned fibers 42, such as liquid crystal polymer fibers. The fibers 42 are held together in an aligned group using a plurality of bands 43 for example. It has been found that the insert 41 provides an enhancement to the load capacity of sling 10 or grommet 11 when maintained in an unwoven configuration as shown in FIGS. 8 and 14, the unwoven fibers 42 being simply placed side by side in an aligned configuration and held together with bands 43.

In FIG. 14, insert 41 is shown being inserted into sling member 11 at lifting eye 18, beginning at opening 45 and exiting at opening 46. Arrows 44 in FIG. 14 illustrate the path that is traveled by splicing tool 28 and the attached insert 41. Arrow 47 in FIG. 14 schematically illustrates the exit of splicing tool 28 from opening 46. Once the insert 41 is placed within a selected area such as the bite area of a sling 10 as shown in FIG. 15, a spiral cut sleeve 22, or one of the thimbles shown in FIGS. 16-18, can be placed over the area that has become thickened by the presence of the insert 41. This thickened area increases sling strength at the bite point and bite area.

Figure 18:
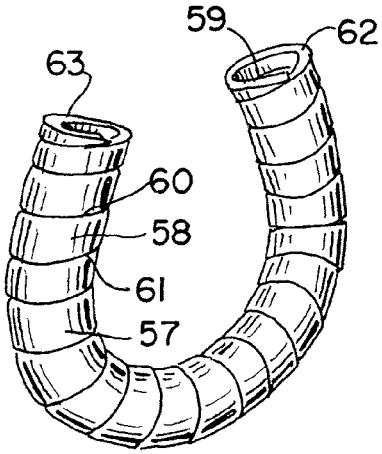
FIG. 18 is a fragmentary, perspective view of the preferred embodiment of the apparatus of the present invention illustrating the preformed spiral cut thimble portion thereof.
Figure 16:
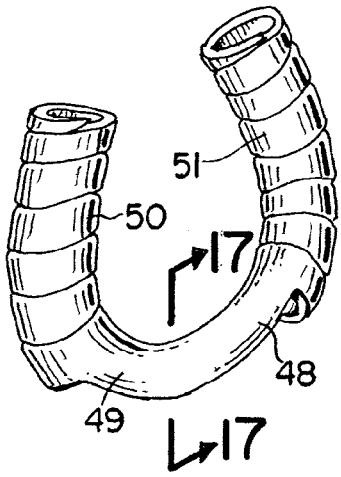
FIG. 16 is a fragmentary perspective view of the preferred embodiment of the apparatus of the present invention showing the preformed thimble with spiral cut end portions thereof.
Figure 17:
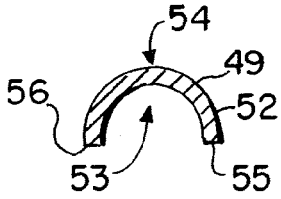
FIG. 17 is a sectional view taken along lines 17-17 of FIG. 16.
Figure 19:
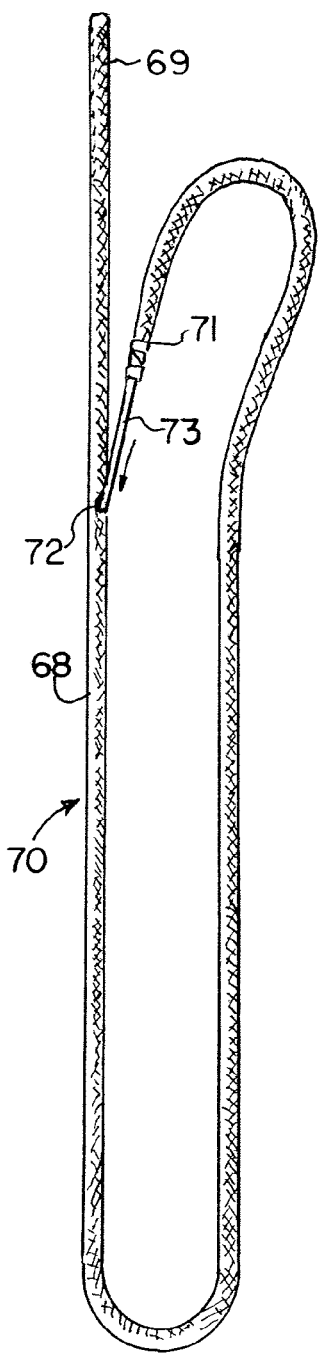
FIG. 19 is a front, elevational, schematic view illustrating the beginning of construction of the grommet embodiment.

In FIGS. 16-18, other configurations for reinforcement of the bite area 34 are shown. In FIG. 16, thimble 48 includes a solid (eg. molded) portion 49 having a U shaped cross section as shown in FIG. 17. The solid portion 49 has a U shaped wall 52 that can be integrally connected to the spiral cut ends 50, 51 such as by molding. In FIG. 17, the thimble 48 includes solid portion 49 having a concavity 53 and a convex outer surface 54. The concavity 53 is occupied by a portion of the lifting eye 18 at the bite area 34. The solid portion 49 has edges 55, 56 as shown in FIGS. 16 and 17. A pair of spiral cut sleeve end portions 50, 51 are attached (eg. integrally molded) to solid portion 49 as shown in FIG. 16.

In FIG. 18, a spiral cut thimble sleeve 57 is shown that is formed by molding, for example. This differs from the embodiment of FIGS. 12 and 13 for the sleeves 22, 23 in that the spiral cut thimble 57 is formed in the shape shown in FIG. 18, designed to track the shape of a lifting eye 16 or 18. The spiral cut thimble 57 is thus adapted to be placed at the bite area 34 of a lifting eye 16 or 18 or at the bite area of a grommet 70. The spiral cut thimble 57 has an outer wall 58 that is segmented, having leading and trailing edges 60, 61, a bore 59, and ends 62, 63.

Figure 22:
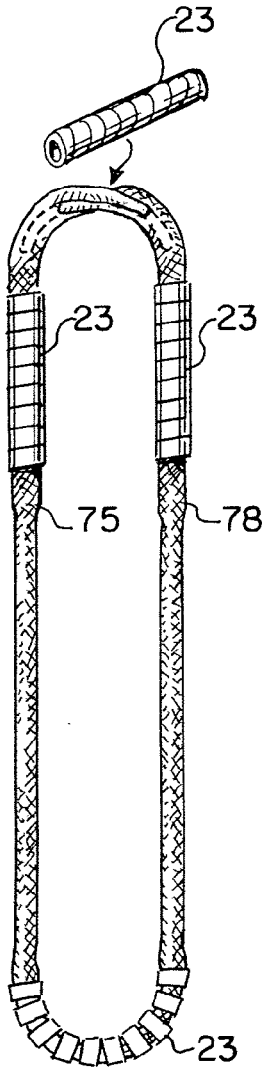
FIG. 22 is a front, elevation schematic view illustrating the grommet embodiment and illustrating placement of spiral cut sleeves at the bite and splice areas.
Figure 25:
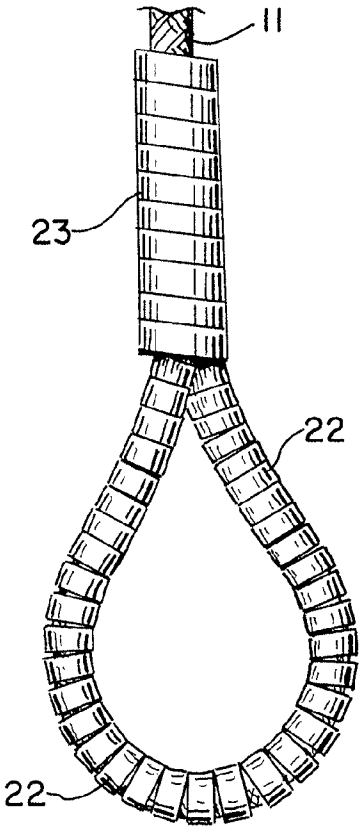
FIGS. 23-25 are front elevational views of the preferred embodiment of the apparatus of the present invention showing a sling during forming, and wherein a first spiral cut sleeve completely covers the lifting eye and a section of the sling next to the lifting eye, and a second spiral sleeve covers the first spiral sleeve on the sling next to the lifting eye.
Figure 24:
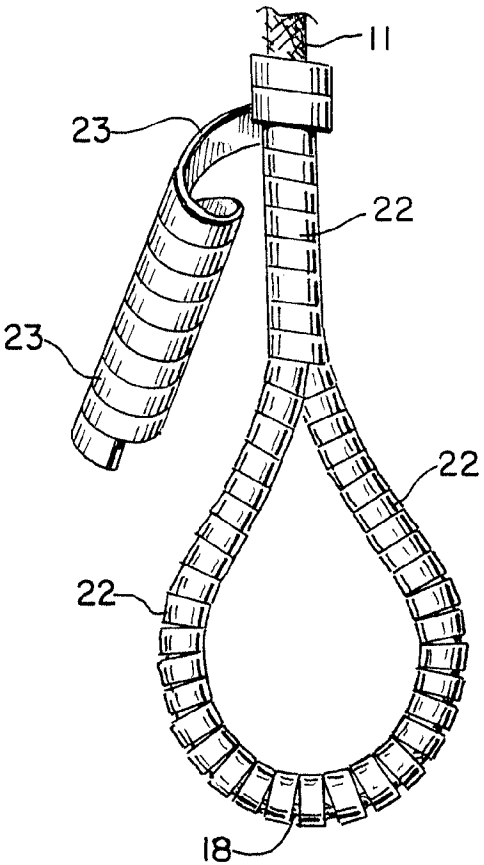
Figure 23:
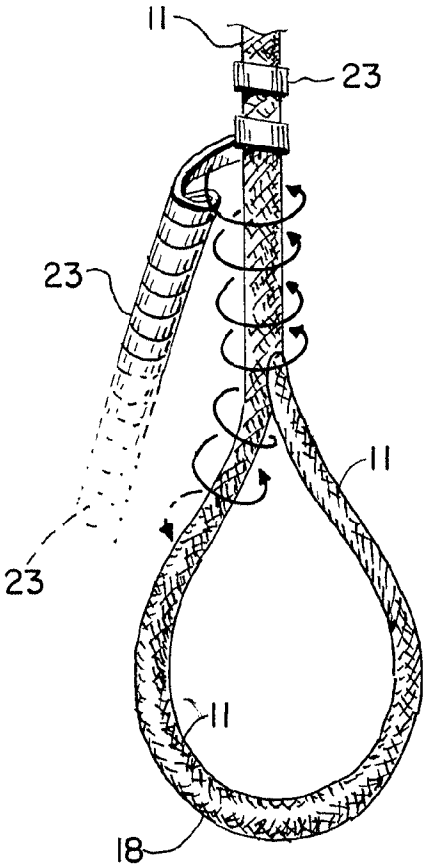

In FIGS. 23-25, a variation is disclosed for the placement of the spiral cut sleeves 22, 23. In FIG. 23, the spiral cut sleeve 23 is first being shown applied to a lifting eye 18. FIGS. 22 and 23 illustrate that the lifting eye 18 is completely covered with spiral cut sleeve 23. In FIGS. 24 and 25, a second spiral cut sleeve 23 is applied over the first spiral cut sleeve 22 but only at a position directly above the lifting eye 18 as shown i FIG. 25.

In FIGS. 19-22, the construction of grommet 70 is shown beginning with an elongated grommet member 68 having end portions 69, 71. An entry point 72 is selected for placement of splicing tool 73 thereinto. Arrow 74 indicates schematically the insertion of splicing tool 73 into the central passageway of grommet member 68.

Figure 20:
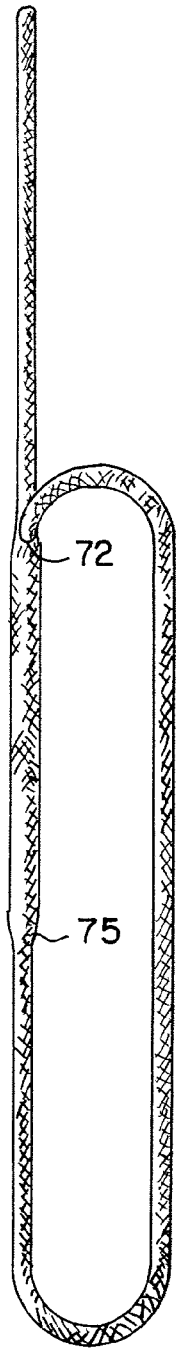
FIG. 20 is a front elevation, schematic view illustrating a further construction of the grommet embodiment.
Figure 21:
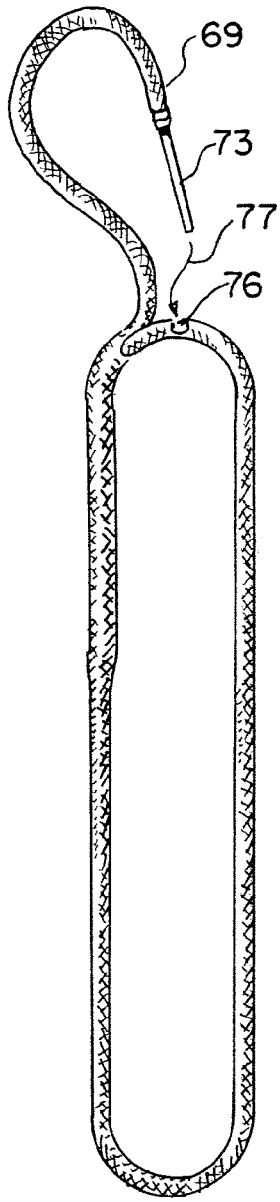
FIG. 21 is yet another front, elevational, schematic view illustrating construction of the grommet embodiment.

The cross sectional configuration of the grommet member 68 can be identical to that of the sling member 11 shown in FIGS. 10 and 11. In FIG. 20, the numeral 75 indicates the position of end 71 after being embedded in the passageway of grommet member 68. In FIG. 21, the splicing tool 73 is attached to end 69 and inserted into opening 76 as indicated by arrow 77 in FIG. 21.

In FIG. 22, the end 69 of grommet member 68 is embedded to the position 78 shown in FIG. 22. In order to complete the grommet 70, spiral cut sleeves 23 are placed over each of the splice areas as shown in FIG. 22. The areas to be attached to a lifting crane or a load to be lifted are covered with spiral cut sleeves 23 or either of the thimbles 48, 57 shown in FIGS. 16-18.

The completed grommet 70 is shown in FIG. 3 being attached to hook 65 attached to lifting lines 64 at one end. The other end of grommet 70 attaches at shackle 21 to load 20.

PARTS LIST

The following is a list of parts and materials suitable for use in the present invention:

| Part Number | Description |
|---|---|
| 10 | lifting sling |
| 11 | sling member |
| 12 | first end |
| 13 | band |
| 14 | second end |
| 15 | band |
| 16 | lifting eye |
| 17 | opening |
| 18 | lifting eye |
| 19 | opening |
| 20 | load |
| 21 | shackle |
| 22 | spiral cut sleeve |
| 23 | spiral cut sleeve |
| 24 | user's hand |
| 25 | user's hand |
| 26 | arrow |
| 27 | woven portion |
| 28 | splicing tool |
| 29 | arrow |
| 30 | expanded section |
| 31 | opening |
| 32 | position |
| 33 | central passageway |
| 34 | bite area |
| 35 | tube |
| 36 | tube bore |
| 37 | tube wall |
| 38 | cut line |
| 39 | edge |
| 40 | edge |
| 41 | insert |
| 42 | fiber |
| 43 | band |
| 44 | arrow |
| 45 | opening |
| 46 | opening |
| 47 | arrow |
| 48 | thimble |
| 49 | solid portion |
| 50 | spiral cut end |
| 51 | spiral cut end |
| 52 | ushaped wall |
| 53 | concavity |
| 54 | convex surface |
| 55 | edge |
| 56 | edge |
| 57 | spiral cut thimble |
| 58 | outer wall |
| 59 | bore |
| 60 | edge |
| 61 | edge |
| 62 | end |
| 63 | end |
| 64 | lifting line |
| 65 | lifting hook |
| 66 | arrow |
| 67 | bite area |
| 68 | grommet member |
| 69 | end portion |

-continued

| Part Number | Description |
|---|---|
| 70 | grommet |
| 71 | end portion |
| 72 | entry |
| 73 | splice tool |
| 74 | arrow |
| 75 | position |
| 76 | opening |
| 77 | arrow |
| 78 | position |

The foregoing embodiments are presented by way of example only; the scope of the present invention is to be limited only by the following claims.

The invention claimed is:

1. A lifting sling, comprising:

a) an elongated sling member that includes an elongated woven portion having first and second ends and a central passageway surrounded by woven material;

b) first and second connections that join each end to the woven portion at the central passageway, and at spaced apart positions;

c) at least one of the ends being connected to the woven portion to form a loop that can be engaged by a lifting member;

d) a flexible spirally wrapped non-metallic polymeric sleeve that fits the loop, said sleeve being a separate member that is not a part of the sling woven portion, defining an interface between the loop and a lifting member that engages the loop, said sleeve being in the form of a polymeric tube having a tube wall thickness and a tube bore that is sized to provide compression to the connections;

e) wherein the non-metallic polymeric sleeve spirally wraps around and compresses at least one of the connections; and f) wherein the sleeve applies compression to the connection by a combination of tube bore diameter and tube wall thickness and not by manual or machine induced loading applied during wrapping.

2. The lifting sling of claim 1 further comprising a second flexible sleeve that is fitted to the woven portion at the connection of one of the ends to the woven portion.

3. The lifting sling of claim 1 wherein the flexible sleeve includes a spirally configured portion that envelops one of the connections.

4. The lifting sling of claim 1 wherein the flexible sleeve is a polymeric member.

5. The lifting sling of claim 1 wherein the flexible sleeve is of a polyurethane material.

6. The lifting sling of claim 1 wherein the flexible sleeve includes polymeric material that contacts the sling during use.

7. The lifting sling of claim 1 wherein the flexible sleeve extends from a position next to the loop to a position spaced away from the loop.

8. The lifting sling of claim 1 wherein the sling has a pair of loops formed next to the ends.

9. The lifting sling of claim 1 wherein the sling is in the form of a ring shaped grommet that defines said loop.

10. The lifting sling of claim 9 wherein the ends attach to the woven portion at positions that are close together.

11. The lifting sling of claim 1 further comprising an insert that is placed into the central passageway to increase the cross sectional area of the woven portion during use.

12. The lifting sling of claim 11 wherein the insert is of a non-woven material.

13. The lifting sling of claim 12 wherein the insert is of a plurality of fibers that are aligned in a bundle.

14. The lifting sling of claim 11 wherein the insert is of a polymeric material.

15. The lifting sling of claim 11 wherein the insert is of a plurality of fibers that are aligned in a bundle.

16. A lifting sling, comprising:

a) an elongated sling member that includes an elongated woven portion having first and second ends and a central passageway surrounded by woven material;

b) first and second connections that join each end to the woven portion at the central passageway, and at spaced apart positions;

c) each of the ends being connected to the woven portion to form a loop that can be engaged by a lifting member; and d) flexible spirally wrapped non-metallic polymeric sleeves that are fitted respectively to the loops, each sleeve being a separate member that is not a part of the sling member woven portion, defining an interface between the loop and a lifting member or lifted member that engages the loop, said sleeve being in the form of a polymeric tube having a tube wall thickness and a tube bore that is sized to provide compression to the connections;

e) at least one polymeric sleeve spirally wraps and compresses a connection; and f) wherein the sleeve applies compression to the connection by a combination of tube bore diameter and tube wall thickness and not by manual or machine induced loading applied during wrapping.

17. The lifting sling of claim 16 further comprising third and fourth flexible sleeves that are fitted to the woven portion at the connection of each of the ends to the woven portion.

18. The lifting sling of claim 16 wherein each of the flexible sleeves includes a spirally configured portion.

19. The lifting sling of claim 16 wherein at least one of the flexible sleeves is a polymeric member.

20. The lifting sling of claim 16 wherein at least one of the flexible sleeves is of a polyurethane material.

21. The lifting sling of claim 16 wherein at least one of the flexible sleeves includes polymeric material that contacts the sling during use.

22. The lifting sling of claim 16 wherein the at least one of flexible sleeves extends from a position next to a loop to a position spaced away from the loop.

23. The lifting sling of claim 16 further comprising an insert that is placed into the central passageway to increase the cross sectional area of the woven portion during use.

24. The lifting sling of claim 23 wherein the insert is of a non-woven material.

25. The lifting sling of claim 23 wherein the insert is of a polymeric material.

26. The lifting sling of claim 23 wherein the insert is of a plurality of fibers that are aligned in a bundle.

27. The lifting sling of claim 23 wherein the insert is of a plurality of fibers that are aligned in a bundle.

28. A lifting grommet, comprising:

a) an elongated grommet member that includes an elongated woven portion having first and second ends and a central passageway surrounded by woven material;

b) first and second connections that join each end to the woven portion at the central passageway;

c) each of the ends being connected to the woven portion to form a an endless circular grommet member that can be engaged by a lifting member; and d) a plurality of non-metallic polyurethane flexible sleeves that spirally wrap around the grommet member, at least one sleeve fitting the grommet member at one of the connections, spirally wrapping around and compressing the connection, another of the sleeves defining an interface between the grommet and a lifting member or a lifted member that engages the loop, each sleeve being a polymeric tube having a tube bore that has been spirally cut and not adhesive or rubber tape;

e) wherein the sleeves are not part of the grommet woven portion; and f) wherein the sleeve applies compression to the connection by a combination of tube bore diameter and tube wall thickness and not by a manual or machine induced loading applied during wrapping.

29. The grommet of claim 28 further comprising a second flexible sleeve that is fitted to the woven portion at the connection of one of the ends to the woven portion.

30. The grommet of claim 28 wherein the flexible sleeve includes a spirally configured portion.

31. The grommet of claim 28 wherein the flexible sleeve is a polymeric member.

32. The grommet of claim 28 wherein the flexible sleeve is of a polyurethane material.

33. The grommet of claim 28 wherein the flexible sleeve includes polymeric material that contacts the grommet during use.

34. The grommet of claim 28 wherein the flexible sleeve extends from a position next to the loop to a position spaced away from the loop.

35. The grommet of claim 28 wherein the sling has a pair of loops formed next to the ends.

36. The grommet of claim 28 wherein the sling is in the form of a ring shaped grommet that defines said loop.

37. The grommet of claim 28 wherein the ends attach to the woven portion at positions that are close together.

38. The grommet of claim 28 further comprising an insert that is placed into the central passageway to increase the cross sectional area of the woven portion during use.

39. The grommet of claim 38 wherein the insert is of a non-woven material.

40. The lifting sling of claim 39 wherein the insert is of a plurality of fibers that are aligned in a bundle.

41. The grommet of claim 38 wherein the insert is of a polymeric material.

42. The lifting sling of claim 38 wherein the insert is of a plurality of fibers that are aligned in a bundle.

43. A lifting sling, comprising:

a) an elongated sling member that includes an elongated woven portion having first and second ends and a central passageway surrounded by woven material;

b) first and second connections that join each end to the woven portion at the central passageway, and at spaced apart positions;

c) at least one of the ends being connected to the woven portion to form a loop that can be engaged by a lifting member;

d) a flexible non-metallic spirally cut polymeric tube having a tube bore and a tube wall thickness and that is connected to the loop, said tube being a separate member that is not a part of the sling woven portion;

e) wherein the non-metallic spirally cut tube is spirally wrapped around and compresses at least one of the connections; and f) wherein the tube applies compression to the connection by a combination of tube bore diameter and tube wall thickness and not by manual or machine induced loading applied during wrapping.

44. The lifting sling of claim 43 further comprising a second flexible tube that is fitted to the woven portion at the connection of one of the ends to the woven portion.

45. The lifting sling of claim 43 wherein the flexible tube includes a spirally configured portion that envelops one of the connections.

46. The lifting sling of claim 43 wherein the flexible tube is a polymeric member.

47. The lifting sling of claim 43 wherein the flexible tube is of a polyurethane material.

48. The lifting sling of claim 43 wherein the flexible tube extends from a position next to the loop to a position spaced away from the loop.

49. The lifting sling of claim 43 wherein the sling has a pair of loops formed next to the ends.

50. The lifting sling of claim 43 wherein the sling is in the form of a ring shaped grommet that defines said loop.

51. The lifting sling of claim 43 wherein the ends attach to the woven portion at positions that are close together.

52. The lifting sling of claim 43 further comprising an insert that is placed into the central passageway to increase the cross sectional area of the woven portion during use.

53. The lifting sling of claim 43 wherein the insert is of a non-woven material.

54. The lifting sling of claim 43 wherein the insert is of a polymeric material.

55. The lifting sling of claim 43 wherein the insert is of a plurality of fibers that are aligned in a bundle.

56. The lifting sling of claim 55 wherein the insert is of a plurality of fibers that are aligned in a bundle.

* * * * *